US006582265B1

(12) United States Patent
Graham

(10) Patent No.: US 6,582,265 B1
(45) Date of Patent: Jun. 24, 2003

(54) FLOATATION TOY

(76) Inventor: Shawn P. Graham, 1078 Dorwood Pk, Ransomville, NY (US) 14131

( * ) Notice: Subject to any disclaimer, the term of this patent is extended or adjusted under 35 U.S.C. 154(b) by 0 days.

(21) Appl. No.: 10/056,333

(22) Filed: Jan. 25, 2002

(51) Int. Cl.[7] ..... B63B 35/58
(52) U.S. Cl. ..... 441/40; 114/345; 472/13
(58) Field of Search ..... 114/345; 441/39, 441/40; 472/13

(56) References Cited

U.S. PATENT DOCUMENTS 2,124,062 A 7/1938 Grant et al.
3,574,874 A 4/1971 Chafin
4,556,391 A 12/1985 Tardivel
4,811,682 A 3/1989 Hwang et al.
5,564,357 A * 10/1996 Peterson ..... 114/345
5,713,294 A * 2/1998 Wang ..... 114/345
5,729,840 A * 3/1998 Wu ..... 114/345
D407,778 S 4/1999 Peterson
6,010,381 A 1/2000 Peterson

* cited by examiner

*Primary Examiner*—Jesus D. Sotelo

(57) ABSTRACT

A floatation toy for providing a floatation device which resembles a boat includes a bottom wall and a peripheral wall fluidly coupled to and extending upwardly from the bottom wall. The bottom and peripheral wall is generally hollow and comprising a flexible material. The flexible material is airtight. The peripheral wall includes a back wall and a pair of side walls. The side walls converge into a front portion such that the a combination of the bottom wall and the peripheral wall resembles a boat. A valve is fluidly coupled to the peripheral wall for selectively inflating and deflating the bottom and peripheral walls.

10 Claims, 2 Drawing Sheets

FLOATATION TOY

BACKGROUND OF THE INVENTION

1. Field of the Invention

The present invention relates to floatation devices and more particularly pertains to a new floatation toy for providing a floatation device which resembles a boat.

2. Description of the Prior Art

The use of floatation devices is known in the prior art. U.S. While these devices fulfill their respective, particular objectives and requirements, the need remains for an inflatable toy which resembles a boat so that children may play war games with boats.

SUMMARY OF THE INVENTION

The present invention generally comprises a bottom wall and a peripheral wall fluidly coupled to and extending upwardly from the bottom wall. The bottom and peripheral wall is generally hollow and comprising a flexible material. The flexible material is airtight. The peripheral wall includes a back wall and a pair of side walls. The side walls converge into a front portion such that the a combination of the bottom wall and the peripheral wall resembles a boat. A valve is fluidly coupled to the peripheral wall for selectively inflating and deflating the bottom and peripheral walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are front portioned out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
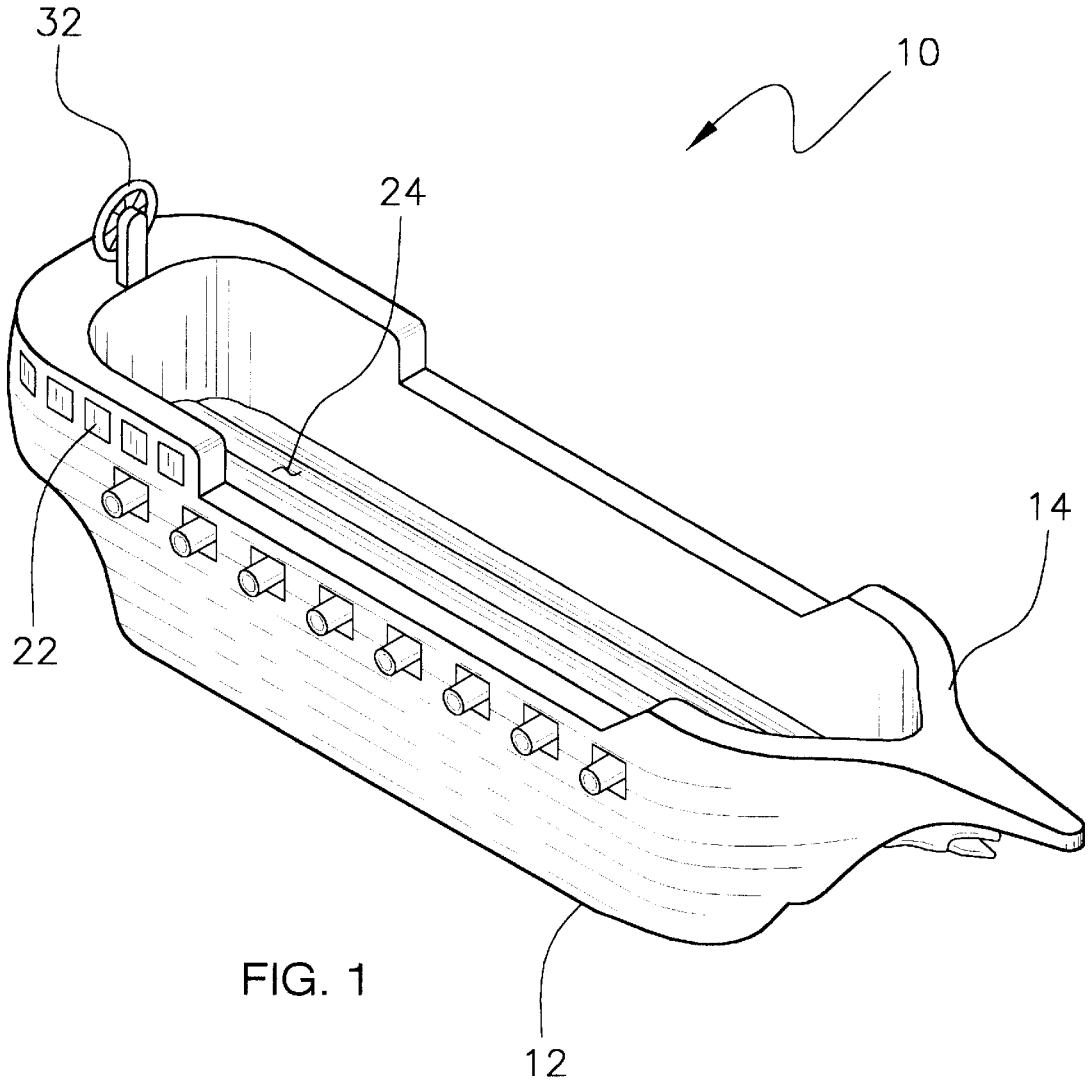
FIG. 1 is a schematic perspective view of a new floatation toy according to the present invention.
Figure 2:
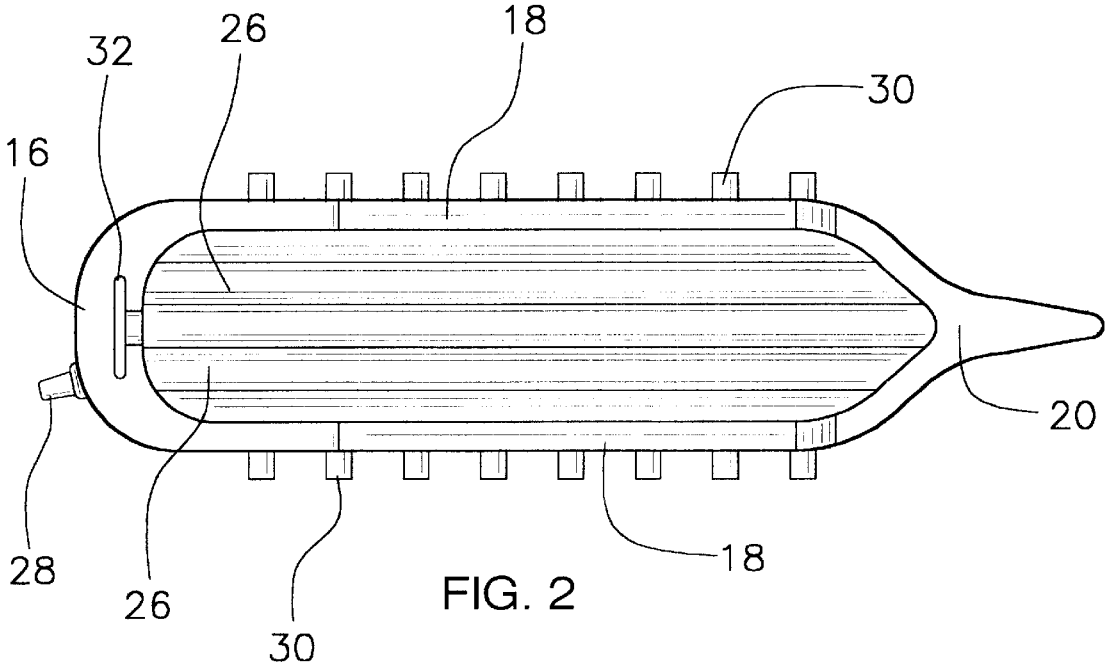
FIG. 2 is a schematic top view of the present invention.
Figure 3:
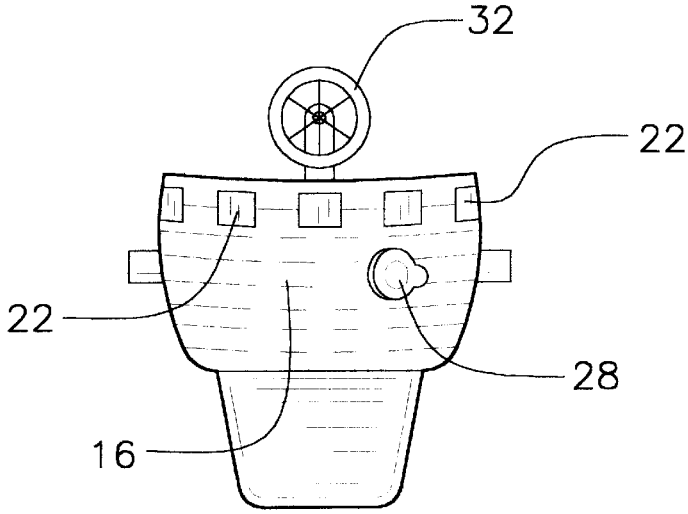
FIG. 3 is a schematic back view of the present invention.

With reference now to the drawings, and in particular to FIGS. 1 through 3 thereof, a new floatation toy embodying the principles and concepts of the present invention and generally designated by the reference numeral 10 will be described.

As best illustrated in FIGS. 1 through 3, the floatation toy 10 generally comprises a bottom wall 12 and a peripheral wall 14 that is fluidly coupled to and extends upwardly from the bottom wall 12. The bottom 12 and peripheral 14 walls are generally hollow and comprise a flexible material which is airtight and is ideally a plastic. The peripheral wall 14 includes a back wall 16 and a pair of side walls 18. The side walls 18 converge into a front portion 20 such that a combination of the bottom wall 12 and the peripheral wall 14 resembles a boat. The back wall 16 has an outer surface having a plurality of depressions 22 therein to resemble windows. Preferably, the depressions 22 extend over into the side walls 18. The bottom wall 12 has an upper surface 24 having a plurality of elongate ribs 26 therein extending away from the back wall 16 to give the bottom wall 12 more stability. The upper surface 24 ideally has a length between 3 feet and 5 feet and a width between 1 foot and 2 feet. A valve 28 is fluidly coupled to the peripheral wall 14 for selectively inflating and deflating the bottom 12 and peripheral 14 walls.

The side walls each have a top edge, with a lowered central segment for facilitating embarkation and disembarkation of the inflatable floatation device by the user.

A plurality of simulated cannons 30 is preferably attached to an outer surface of each of the side walls 18. A simulated steering wheel 32 is preferably attached to an upper edge of the peripheral wall 18 and is ideally positioned on the back wall 16.

In use, the device 10 is used as a floatation toy having the shape of a boat. The device 10 may be offered in a plurality of boat shapes, such as destroyers, battleships and carriers so that children may play different war games with the toys.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable floatation device comprising:

a bottom wall and a peripheral wall being fluidly coupled to and extending upwardly from said bottom wall, said bottom and peripheral wall being generally hollow and comprising a flexible material, said flexible material being airtight, said peripheral wall including a back wall and a pair of side walls, said side walls converging into a front portion such that a combination of said bottom wall and said peripheral wall resembles a boat;

said side walls each having a top edge, said top edge having a lowered central segment for facilitating embarkation and disembarkation of the inflatable floatation device by the user;

a valve being fluidly coupled to said peripheral wall for selectively inflating and deflating said bottom and peripheral walls;

a keel member coupled to a bottom side of said bottom wall, said keel member inhibiting rolling of the device around a longitudinal axis; and said device having an overall width and an overall length, said overall width being approximately one fourth of said overall length.

2. The inflatable floatation device as in claim 1, wherein said back wall has an outer surface having a plurality of depressions therein.

3. The inflatable floatation device as in claim 2, further including a simulated steering wheel being attached to an upper edge of said peripheral wall, said steering wheel being positioned on said back wall.

4. The inflatable floatation device as in claim 1, wherein said bottom wall has an upper surface having a plurality of elongate ribs therein extending away from said back wall.

5. The inflatable floatation device as in claim 1, wherein said bottom wall has an upper surface having a length generally between 3 feet and 5 feet and a width generally between 1 foot and 2 feet.

6. The inflatable floatation device as in claim 1, further including a plurality of simulated cannons being attached to an outer surface of each of said side walls.

7. The inflatable floatation device as in claim 1, further including a simulated steering wheel being attached to an upper edge of said peripheral wall, said steering wheel being positioned on said back wall.

8. An inflatable floatation device comprising:

a bottom wall and a peripheral wall being fluidly coupled to and extending upwardly from said bottom wall, said bottom and peripheral wall being generally hollow and comprising a flexible material, said flexible material being airtight, said peripheral wall including a back wall and a pair of side walls, said side walls converging into a front portion such that a combination of said bottom wall and said peripheral wall resembles a boat, said back wall having an outer surface having a plurality of depressions therein, said bottom wall having an upper surface having a plurality of elongate ribs therein extending away from said back wall, said upper surface having a length generally between 3 feet and 5 feet and a width generally between 1 foot and 2 feet;

a plurality of simulated cannons being attached to an outer surface of each of said side walls;

a simulated steering wheel being attached to an upper edge of said peripheral wall, said steering wheel being positioned on said back wall;

a valve being fluidly coupled to said peripheral wall for selectively inflating and deflating said bottom and peripheral walls; and wherein said side walls each having a top edge, said top edge having a lowered central.segment for facilitating embarkation and disembarkation of the inflatable floatation device by the user.

9. The device of claim 8, wherein said device having an overall width and an overall length, said overall width being approximately one fourth of said overall length.

10. The device of claim 8, further comprising a keel member coupled to a bottom side of said bottom wall, said keel member inhibiting rolling of the device around a longitudinal axis.

* * * * *